US005174063A

United States Patent [19]

Lewis et al.

[11] Patent Number: 5,174,063

[45] Date of Patent: Dec. 29, 1992

[54] WINDOW GRILL RELEASE

[76] Inventors: Gary B. Lewis, P.O. Box 7311, San Diego, Calif. 92167; Charles R. Temple, Jr., 264 C Rancho Ct., Chula Vista, Calif. 91911

[21] Appl. No.: 750,271

[22] Filed: Aug. 27, 1991

[51] Int. Cl.[5] ..... E05B 65/10

[52] U.S. Cl. ..... 49/141; 49/56

[58] Field of Search ..... 49/141, 56, 57, 50

[56] References Cited

U.S. PATENT DOCUMENTS

| | | | |
|---|---|---|---|
| 4,055,360 | 10/1977 | Russi | 49/141 X |
| 4,208,837 | 6/1980 | Black, Sr. et al. | 49/141 X |
| 4,263,747 | 4/1981 | Coltran | 49/56 |
| 4,616,863 | 10/1986 | Bryant | 49/56 X |
| 4,856,229 | 8/1989 | Tserng | 49/56 |
| 4,897,961 | 2/1990 | Shine | 49/379 |

*Primary Examiner*—Philip C. Kannan
*Attorney, Agent, or Firm*—John R. Ross

[57] ABSTRACT

A releasing system for retaining a cover over an opening in a structure. A penetrating member connected to the protective cover is tapered at one end and has a notch just beyond the taper. A housing contains a spring latch made of bent steel strip. One end of the spring latch is firmly attached to the housing and the free end of the spring latch is located behind and partially covers an opening in the housing. The spring latch is positioned so that the tapered portion of said penetrating member will push the free end of the spring latch aside when the penetrating member is entering the housing, and the free end will fit into said notch when the penetrating member is essentially fully inserted into said housing. One end of a release cable is attached to the spring latch near its free end and when pulled with sufficient force will cause the free end of the spring latch to be pulled out of the notch releasing the penetrating member.

4 Claims, 2 Drawing Sheets

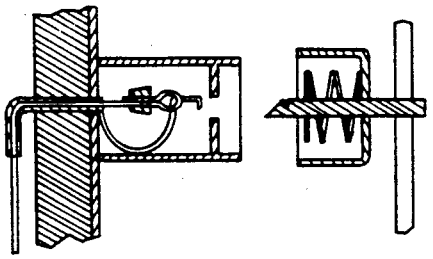
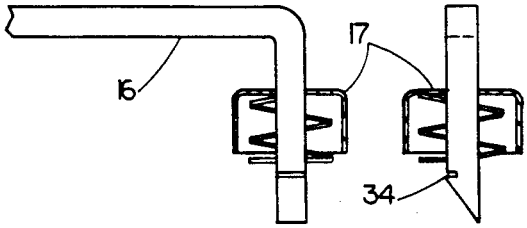
FIG. 4A FIG 4B
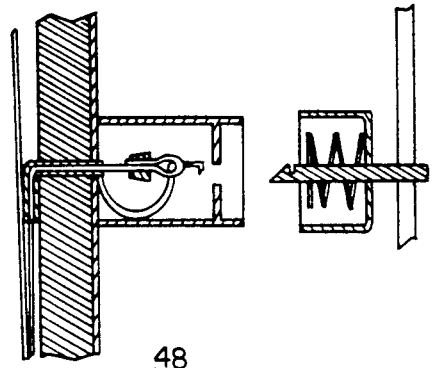
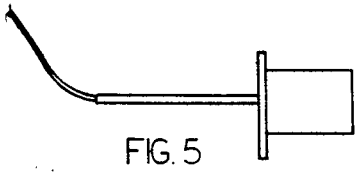
FIG. 5
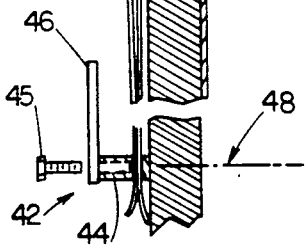
FIG. 6
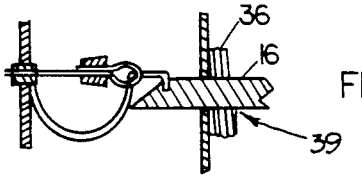
FIG. 7
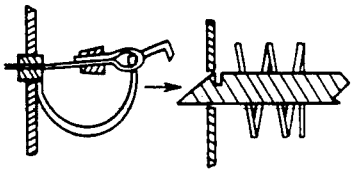
FIG.8
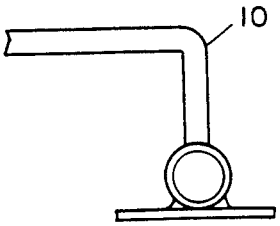
FIG. 9A
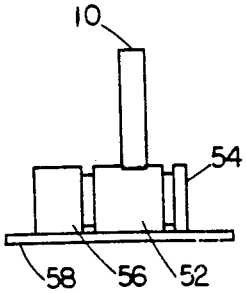
FIG. 9B

WINDOW GRILL RELEASE

This invention relates to emergency releases and in particular releases for window grills.

BACKGROUND OF THE INVENTION

Due to increasing crime risk especially in urban areas, many people desire to have metal bars covering their windows. Many fire codes, however, require that a quick release mechanism be provided when the window covered is a potential emergency escape route. They still must provide at least some semblance of security from unwanted entry.

Quick release devices for window bar sets are currently commercially available. However, current devices typically utilize machined parts which are relatively expensive and in some cases are not entirly secure.

SUMMARY OF THE INVENTION

The present invention provides a releasing system for a security cover over an opening in a structure. A penetrating member connected to the protective cover is tapered at one end and has a notch just beyond the taper. A housing contains a spring latch made of bent steel strip. One end of the spring latch is firmly attached to the housing and the free end of the spring latch is located behind and partially covers an opening in the housing. The spring latch is positioned so that the tapered portion of said penetrating member will push the free end of the spring latch aside when the penetrating member is entering the housing, and the free end will fit into said notch when the penetrating member essentially fully inserted into said housing. One end of a release cable is attached to the spring latch near its free end and when pulled with sufficient force will cause the free end of the spring latch to be pulled out of the notch releasing the penetrating member.

BRIEF DESCRIPTION OF THE DRAWINGS

FIGS. 4A and 4B are two views of the penetrating member.

FIG. 5 shows how a release cable is positioned with respect to the housing.

FIG. 6 shows all of the principal parts in place prior to latching.

FIG. 7 shows a latched configuration.

FIG. 8 shows a release condition.

FIGS. 9A and 9B are two views of a preferred hinge assembly.

DETAILED DESCRIPTION OF PREFERRED EMBODIMENTS

The present invention can be described by reference to the figures.

Figure 1:
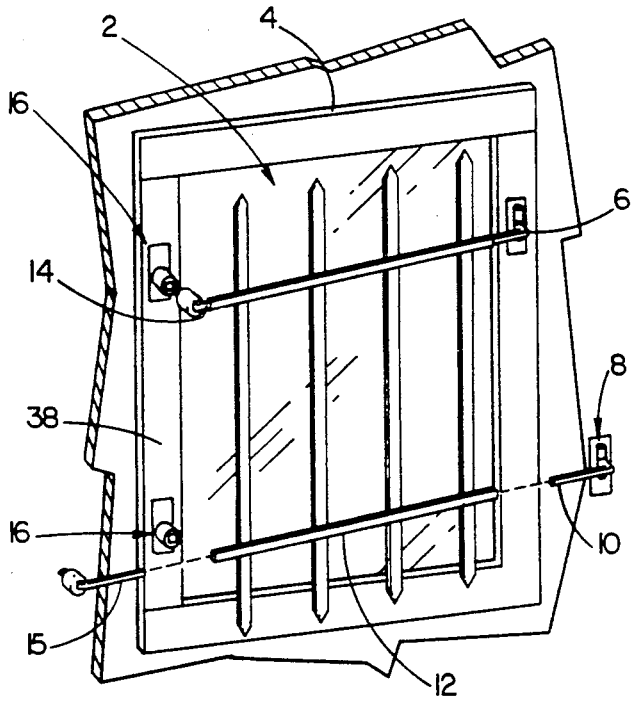
FIG. 1 shows a grill in place on a window frame.

FIG. 1 shows a bar set 2 in place on a window 4. The bar set is comprised primarly of four verticle and two square hollow horizontal bars made of hollow square steel tubes. The set also comprises top and bottom hinge assemblies 6 and 8 and connector bars 14 and 15 which are comprised of square steel bar with side dimension slightly less than the inside dimension of the square horizontal steel tubes.

The top hinge assembly 6 is shown in place and the bottom hinge assemble 8 is shown dispaced to show how the hinge assembly bar 50 slides inside the bottom horizontal window bar 12.

The top connector bar 14 is also shown in place and the bottom connector bar 16 is shown displaced, again to show how it slips inside bar 12.

Figure 2A:
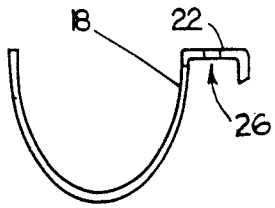
FIGS. 2A and 2B show two views of the spring latch.
Figure 2B:
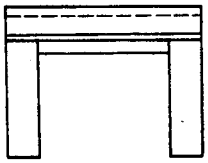

Two latch assemblies 15 are utilized to latch the window bar set in place. The principal element in latch assembly 16 is stainless steel spring latch 18 shown by itself in FIGS. 2A and 2B. It is preferably made by a stamping operation. Spring latch 18 can be made of stainless or spring steel, however we are using the stainless because of its corrosion resistance. Spring latch 18 is formed from a coil of steel by a stamping operation which first blanks holes and shears the part from coil. Next the part is formed to its final shape FIG. 2A by a stamp forming operation.

Figure 3:
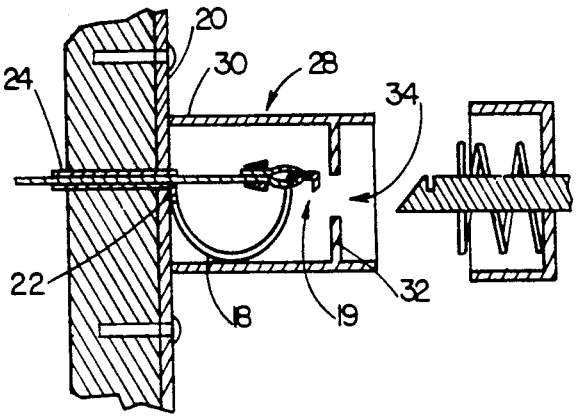
FIG. 3 shows the penetrating member about to enter the housing and also shows the spring latch in its relaxed position inside the housing.

To form latch assembly 16, latch 18 is welded to plate 20 at 22 as shown in FIG. 3 a 8-inch long 3/16 inch OD and approximately $\frac{1}{8}$ inch ID steel tube 24 is fitted through a 3/16 inch hole in plate 20. A release cable 25 comprised of 1/16 inch 7×7 air craft cable is fitted through tube 24 and attached to spring latch 18 using a pressed fitting at hole 26. The cable for the top latch assembly is about 7 feet long and for the bottom about 5 feet long.

A housing 28 comprised of a 2 inch section of $1\frac{1}{4}$ inch schedule 10 pipe (1.66 OD×0.109 wall) 30 is then welded to plate 20. A front wall 32 has previously been welded $\frac{1}{2}$ inch inside pipe 30 as shown in FIG. 3. Front wall 32 contains a $\frac{5}{8}$ inch square hole as shown at 34.

A detailed drawing of connector bar 16 is shown in FIG. 4A and 4B. The bar is comprised of solid $\frac{1}{2}$ inch square bar steel. It is $8\frac{1}{2}$ inches long and bent at a right angle at $2\frac{1}{2}$ inches from one end. That end is cut at a 45 degree angle as shown in FIG. 4A and FIG. 4B. A 0.095 inch wide and 5/32 inch deep notch 34 cut as shown in the figure. A spring 36 comprised of an 11 inch section of 0.080 inch diameter spring steel is press fitted at 39 to connector bar 16.

A drawing of latch assembly 28 as it appears prior to installation is shown in FIG. 5. To install latch assembly 28 two $\frac{5}{8}$-inch diameter holes are drilled completely through window frame 38 to the inside of the house and cable 25 and tube 24 are filled through the hole. Plate 20 is fastened to the window with security type bolts.

Tubes 24 and 25 is bent downward as shown at 40 in FIG. 6 and release cables 25 are firmly attached to release lever assemble 42 at bar 44 through two holes in bar 44. Lever 46 of assemble 42 is designed to rotate about axis 48. Therefore, when lever 46 is rotated either clockwise or counter clockwise, release cable 25 will tighten causing the tips 19 of spring latches 18 to move up essentially vertically.

The closed position of latch assemble 28 is shown in FIG. 7. Rotating lever 46 has the effect of releasing connector bar 16. Spring 36 then forces connector bar 16 backward as shown in FIG. 8 opening window bar set 2.

A preferred hinge assembly 6 is shown in FIG. 9A and 9B. It is comprised of $\frac{1}{2}$ inch square steel bar arm 10 and is $8\frac{1}{2}$ inches bent as shown in FIG. 8 and is welded to ring 52. Arm 10 pivots around pin 54 which along with holder ring 56 welded to hinge plate 58. The bar set is filled together as indicated in FIG. 1 and hinge plate 58 and latch assembly plate 20 are bolted to window from 38 as indicated in FIG. 1.

The above described preferred embodiments are intended to illustrate the principals of the invention, but not to limit the scope of the invention. Various other embodiments and modifications to these preferred embodiments may be made by those skilled in the art, without departing from the scope of the following claims.

We claim:

1. A releasing system for retaining a protective cover over an opening in a wall of a structure, said releasing system comprising:

a) a penetrating member connected to said protective cover said penetrating member being comprised of a solid bar said bar 1) being tapered at at least one end, the extreme portions of said taper defining a narrowest part and a widest part of said taper and 2) having a notch near the widest part of said taper b) a latch assembly comprising:

1) a housing assembly comprising an attachment means for attaching said housing assembly to said structure wall and having an opening to permit entrance of said penetrating member, 2) a spring latch means contained inside said housing and comprised of bent steel strip, said strip defining an attachment end and a free end, said attachment end being firmly attached to said housing assembly and said free end being located behind and partially covering said opening and positioned so that i) the tapered portion of said penetrating member will push said free end aside when said tapered portion of said penetrating member is entering said opening in said housing, and ii) said free end will fit into said notch of said penetrating member when said penetrating member is essentially fully inserted into said housing, 3) a release cable means for releasing said penetrating member, said cable means having two ends, one end being attached to said latch means near said free end, said cable means being positioned such that when pulled with sufficient force said free end of said latch spring means will be pulled out of said notch releasing said penetrating member.

2. A releasing system as in claim 1 and further comprising a release lever means for applying tension to said release cable means.

3. A releasing system as in claim 2 wherein said release lever means is positioned at least two feet removed from said latch assembly.

4. A releasable window grill assembly comprising:

1) a window grill, 2) at least two hinges for attaching said grill to a window frame in a structure wall 3) at least two grill releasing systems, each of said releasing systems comprising:

a) a protective cover b) a penetrating member connected to said protective cover said penetrating member being comprised of a solid bar said bar (1) being tapered at at least one end, the extreme portions of said taper defining a narrowest part and a widest part of said taper; and (2) having a notch near the widest part of said taper c) a latch assembly comprising:

(1) a housing assembly comprising an attachment means for attaching said housing assembly to said structure wall and having an opening to permit entrance of said penetrating member, (2) a spring latch means contained inside said housing and comprised of bent steel strip, said strip defining an attachment end and a free end, said attachment end being firmly attached to said housing assembly and said free end being located behind and partially covering said opening in said housing and positioned so that i) the tapered portion of said penetrating member will push said latch end aside when said tapered portion of said penetrating member is entering said housing, and ii) said free end will snap into said notch when said penetrating member is essentially fully inserted into said housing, (3) a release cable means for releasing said penetrating member, said cable means having two ends, one end being attached to said latch means near said free end, said cable means being positioned such that when pulled with sufficient force said latch end of said latch spring means will be pulled out of said notch releasing said penetrating member.

* * * * *